US006622645B2

(12) United States Patent
Havlena

(10) Patent No.: US 6,622,645 B2
(45) Date of Patent: Sep. 23, 2003

(54) COMBUSTION OPTIMIZATION WITH INFERENTIAL SENSOR

(75) Inventor: Vladimir Havlena, Prague (CZ)

(73) Assignee: Honeywell International Inc., Morristown, NJ (US)

( * ) Notice: Subject to any disclaimer, the term of this patent is extended or adjusted under 35 U.S.C. 154(b) by 90 days.

(21) Appl. No.: 09/883,167

(22) Filed: Jun. 15, 2001

(65) Prior Publication Data

US 2003/0000436 A1 Jan. 2, 2003

(51) Int. Cl.[7] ..... F23J 15/00; F23N 5/18

(52) U.S. Cl. ..... 110/348; 110/345; 110/188; 432/37

(58) Field of Search ..... 431/2, 12; 110/185, 110/186, 188, 341, 345, 346, 347; 432/90, 91, 36, 37; 122/4 D; 60/39.55, 39.3

(56) References Cited

U.S. PATENT DOCUMENTS 4,253,404 A * 3/1981 Leonard ..... 110/188
4,308,810 A * 1/1982 Taylor ..... 110/347
4,362,499 A * 12/1982 Nethery ..... 431/12
4,474,121 A * 10/1984 Lewis ..... 110/346
4,517,906 A * 5/1985 Lewis et al. ..... 110/346
4,653,998 A * 3/1987 Sohma et al. ..... 431/79
4,742,783 A * 5/1988 LaSpisa et al. ..... 110/188
4,815,965 A * 3/1989 Likins ..... 431/12
5,040,470 A * 8/1991 Lofton et al. ..... 110/234
5,091,884 A 2/1992 Waltz
5,123,364 A * 6/1992 Gitman et al. ..... 110/346
5,138,958 A * 8/1992 Sinquin et al. ..... 110/346
5,230,293 A * 7/1993 Schirmer ..... 110/346
5,367,470 A 11/1994 Lang
5,398,623 A * 3/1995 Lautenschlager et al. ... 110/346
5,495,813 A * 3/1996 Chapman et al. ..... 110/341
5,496,450 A 3/1996 Blumenthal et al.
5,501,159 A 3/1996 Stevers et al.
5,520,123 A 5/1996 Chappell et al.
5,626,085 A 5/1997 Donais et al.
5,764,535 A 6/1998 Okazaki et al.
5,794,549 A 8/1998 Carter
5,798,946 A 8/1998 Khesin
5,957,063 A * 9/1999 Koseki et al. ..... 110/188

FOREIGN PATENT DOCUMENTS

EP 0519178 A 12/1992
EP 0773408 A 5/1997

OTHER PUBLICATIONS

Patent Abstracts of Japan: vol. 007, No. 179, Aug. 9, 1983; & JP58083118A (Hitachi Seisakusho KK), May 18, 1983 (abstract, figure).

* cited by examiner

*Primary Examiner*—Ira S. Lazarus
*Assistant Examiner*—K. B. Rinehart
(74) *Attorney, Agent, or Firm*—Kris T. Fredrick

(57) ABSTRACT

A method and system for combustion of fuel in a boiler in which flue gasses are produced. The boiler includes a source of fuel, a source of air, and a controller for controlling the ratio of the source of air and the source of fuel inputted into the boiler. A sensor is used for measuring the concentration of oxygen in the flue gasses. The controller is adapted to calculate the amount of air entering the boiler based on the amount of oxygen in the flue gasses to thereby adjust the air to fuel ratio to include calculated air input and air input from the source of air. A preferred fuel is pulverized coal. The method and system provide for the air to fuel ratio to be adjusted to optimize efficiency as well as to minimize $NO_x$ production.

12 Claims, 1 Drawing Sheet

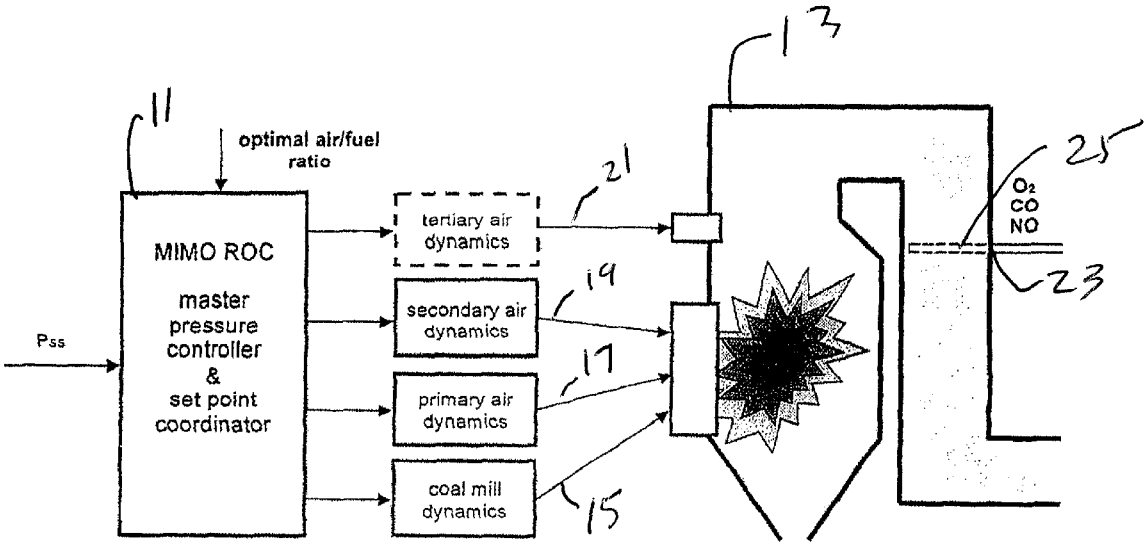
11
13
optimal air/fuel ratio
MIMO ROC
master pressure controller & set point coordinator
Pss
tertiary air dynamics
secondary air dynamics
primary air dynamics
coal mill dynamics
21
19
17
15
25
23
O2
CO
NO

COMBUSTION OPTIMIZATION WITH INFERENTIAL SENSOR

FIELD OF THE INVENTION

The present invention relates to model-based predictive control technology for boiler control. More particularly the invention relates to the coordination of air and fuel during transients to increase efficiency and minimize the production of $NO_x$.

BACKGROUND OF THE INVENTION

The classical approach to combustion air control is to use the measurement of oxygen concentration in flue gas for feedback control of the amount of combustion air. This reactive approach does not guarantee exact air-fuel ration during fast transients. While the standard air-fuel interlock provides acceptable steady-state performance, the solution based on conventional controllers may not be fully satisfactory during the transients, e.g. for boilers operating in cycling regimes, particularly if low-$NO_x$ burning with reduced excess air is used.

Lang U.S. Pat. No. 5,367,470 is one of many patents describing the method of analyzing combustion for improved performance, in this case focusing on repetitive adjustment of assumed water concentration in the fuel until actual and calculated values for efficiency reach steady state. Okazaki et al. U.S. Pat. No. 5,764,535 uses two-dimensional or three-dimensional cells in a furnace as part of a system employing a gas composition table to simplify the calculation. Carter U.S. Pat. No. 5,794,549 employs a plurality of burners to form a fireball to optimize combustion. Likewise, Khesin U.S. Pat. No. 5,798,946 converts a fluctuational component of a signal to an extreme point Chappell et al. U.S. Pat. No. 5,520,123 and Donais et al. U.S. Pat. No. 5,626,085 both disclose systems relating to $NO_x$, using oxygen injection into an afterburner and windbox-to-furnace ratios, respectively. Waltz U.S. Pat. No. 5,091,844 and Blumenthal et al. U.S. Pat. No. 5,496,450 both relate to methodology for control relating to sensor feedback. Finally, Stevers et al U.S. Pat. No. 5,501,159 teaches the use of a jacketed vessel with multiple chambers and air flows.

None of the prior art recognizes the, potential for application of model-based predictive control technology for boiler control that will enable tight dynamic coordination of selected controlled variables, particularly the coordination of air and fuel during the transients.

It would be of great advantage in the art if predictive control technology could be developed that would take into account relatively fast dynamics of boilers and rate limits imposed by the plant life-time considerations.

It would be another great advance in the art if a system could be developed that would focus on power and heat generation to use predictive control technology and rate optimal control to have tight dynamic coordination of selected control variables to result in improved boiler efficiency and reduced $NO_x$ production.

Other advantages will appear hereinafter.

SUMMARY OF THE INVENTION

It has now been discovered that the above and other objects of the present invention may be accomplished in the following manner. Specifically, the present invention employs inferential sensing to estimate the total amount of combustion air for predictive control of air-fuel ratios for pulverized-coal fired boilers and other boiler systems using other fuels. The invention is useful for any fuel burning system, and has been found to be particularly suited for pulverized coal burning boilers.

Using the estimate of the relation between the total air in the boiler rather than just the measured combustion air added to the boiler, the amount of air can be controlled by a predictive controller. The air to fuel ratio is accomplished in fast transients since the system does not have to wait for real-time feedback from analysis of the exhaust gases. The present invention allows the system to use minimum necessary excess air, thus providing low $NO_x$, production and increased efficiency by at least one percent. The invention contemplates the use of what is termed cautious optimization (cautious optimization is related to the uncertainty in CO and NOx), in which the uncertainty of air entering the system from sources other than directly controlled and measured input is inferentially sensed or estimated from the concentration of $O_2$ measured in the flue gasses, which represents all of the air in the boiler.

BRIEF DESCRIPTION OF THE DRAWINGS

For a more complete understanding of the invention, reference is hereby made to the drawings, in which:

The FIGURE is a schematic diagram of a master pressure controller with simultaneous air/fuel setpoint coordination in use with a boiler.

DETAILED DESCRIPTION OF THE PREFERRED EMBODIMENT

The controller system of this invention is based on predictive control technology. Taking into account relatively fast dynamics of boilers and rate limits imposed by the plant life-time considerations, the present invention focuses on power and heat generation applications. The basic idea behind the use of predictive control technology and rate optimal control (ROC) is to enable tight dynamic coordination of selected controlled variables.

A typical application of the MIMO ROC controller 11 for pressure control with simultaneous combustion (air/fuel ratio) optimization is depicted in FIG. 1, where air and fuel are inputted into a boiler 13. In FIG. 1, the fuel (pulverized coal) input 15, and primary air input 17 are controlled by controller 11. In addition to these two essential factors that make up the air to fuel ratio of the boiler, secondary air dynamics input 19 and, when appropriate, tertiary air dynamics input 21 are used as part of the control of the boiler.

Besides the controlled and measured air (the sum of measured primary, secondary and tertiary air are those sources of air around the boiler other than the intentionally introduced air; they represent air that is pulled into the boiler at joints, junctions and other mechanical portions of the boiler. It has been discovered that measurement of the total air in the system is essential for optimum control of the combustion process. While it is not possible or practical to measure air as it is pulled into the boiler, it is relatively easy to measure the amount of air exiting the boiler in flue 23 as part of the flue gasses. These flue gasses contain quantities of CO and $NO_x$, as well as $O_2$, as noted at sensor 25. Controller 11 calculates the total amount of air in the combustion process. From the total air in combustion and the known air input via measured air input 17, 19 and 21, values for additional, or sucked-in air coming in can be calculated.

Based on the data obtained and calculated, the controlled portions of the air to fuel ratio, fuel input 15 and total air 17, 19 and 21 are adjusted to reflect this calculated additional amount of air illustrated at 23 and 25 to optimize the combustion, producing less $N_x$ and increasing the efficiency of the boiler by significant amounts.

In order to demonstrate the efficacy of the present invention, experiments were performed on a commercial boiler. Performance tests were performed on a commercial boiler system using pulverized coal as a fuel, producing superheated steam at a nominal flow of 125 tons per hour.

Presented below in Tables I and II are the results of test before and after the present invention was implemented. The constants were the boiler itself, the fuel as pulverized coal (adjusted for moisture content) from commercial sources, and the control equipment used to adjust the air to fuel ratio. The variable was the use of a sensor to determine oxygen excess in the flue gas, which in turn was used by the control equipment to adjust the air to fuel ratio to include all air rather than input air.

TABLE I

Boiler Performance $NO_x$ Production

| Prior Art Using Measured Air | Invention Using Estimated Total Air |
|---|---|
| maximum at 340 mg/m$^3$ | maximum at 280 mg/m$^3$ |
| range 200 to 500 (mg/m$^3$) | range 150 to 50 (mg/m$^3$) |

Thus, $NO_x$ production was reduced by almost 20%, from average values of 340 mg/m$^3$ to 280 mg/m.

TABLE II

Boiler Performance Efficiency

| Prior Art Using Input Air | Invention Using Total Air |
|---|---|
| 88.1% maximum | 88.8% maximum |
| 87–89% range | 88–89.5% range |

An improvement of nearly 1% efficiency results in substantial economic savings, and is particularly important when combined with reduced pollutants as shown above.

While particular embodiments of the present invention have been illustrated and described, it is not intended to limit the invention, except as defined by the following claims.

What is claimed is:

1. A method of controlling combustion of fuel in a boiler in which flue gasses are produced, comprising the steps of:

providing a source of fuel;

providing a source of air;

providing a controller for controlling the ratio of air to fuel fed into said boiler;

measuring the oxygen content in the flue gasses;

calculating the total amount of air entering said boiler based on the amount of oxygen in the flue gasses; and adjusting the air to fuel ratio by use of a controller adapted to calculate the total amount of air entering said boiler based on the amount of oxygen measured in the flue gasses to control the air to fuel ratio to include calculated total air input and measured air input from said source of air to lower the source amount of air to the minimum air to produce the lowest $NO_x$ production during combustion;

whereby the efficiency and $NO_x$ production are improved.

2. The method of claim 1, wherein the air to fuel ratio is adjusted to optimize efficiency.

3. The method of claim 1, wherein the air to fuel ratio is adjusted to minimize $NO_x$ production.

4. The method of claim 1, wherein said fuel is pulverized coal.

5. A system for combustion of fuel in a boiler in which flue gasses are produced, comprising:

a source of fuel for combustion in said boiler;

a source of air for combustion with said fuel in said boiler;

a controller for controlling the ratio of said source of air and said source of fuel inputted into said boiler; and a sensor for measuring the production of oxygen in the flue gasses; said controller being adapted to calculate the total amount of air entering said boiler based on the amount of oxygen measured in the flue gasses to control the air to fuel ratio to include calculated total air input and air input from said source of air, said controller being adapted to control said source of air for combustion to lower the source amount of air to the minimum air to produce the lowest $NO_x$ production during combustion.

6. The system of claim 5 wherein said fuel is pulverized coal.

7. The system of claim 5 wherein the air to fuel ratio is adjusted to optimize efficiency.

8. The system of claim 5 wherein the air to fuel ratio is adjusted to minimize $NO_x$ production.

9. A system for combustion of fuel in a boiler in which flue gasses are produced, comprising:

fuel source means for providing an input of fuel to said boiler for combustion;

air source means for providing an input of air to said boiler for combustion with said fuel;

controller means for controlling the ratio of said input of air and said input of fuel; and sensor means for measuring the production of oxygen in said flue gasses; said controller means being adapted to calculate the amount of air entering said boiler based on the amount of oxygen measured in the flue gasses to control the air to fuel ratio to include calculated total air input and air input from said source of air;

sensor means for measuring the production of oxygen in the flue gasses; said controller means being adapted to calculate the total amount of air entering said boiler based on the amount of oxygen measured in the flue gasses to control the air to fuel ratio to include calculated total air input and air input from said source of air, said controller means being adapted to control said source of air for combustion to lower the source amount of air to the minimum air to produce the lowest $NO_x$ production during combustion.

10. The system of claim 9 wherein said fuel is pulverized coal.

11. The system of claim 9 wherein the air to fuel ratio is adjusted to optimize efficiency.

12. The system of claim 9 wherein the air to fuel ratio is adjusted to minimize $NO_x$ production.

* * * * *